US007753659B2

(12) United States Patent
Boyl-Davis et al.

(10) Patent No.: US 7,753,659 B2
(45) Date of Patent: Jul. 13, 2010

(54) AXIAL CAM AIR MOTOR

(75) Inventors: Theodore M. Boyl-Davis, Snohomish, WA (US); Alan R. Merkley, Greenbank, WA (US); Ronald W. Outous, Shoreline, WA (US)

(73) Assignee: The Boeing Company, Chicago, IL (US)

( * ) Notice: Subject to any disclaimer, the term of this patent is extended or adjusted under 35 U.S.C. 154(b) by 367 days.

(21) Appl. No.: 11/279,215

(22) Filed: Apr. 10, 2006

(65) Prior Publication Data

US 2007/0234898 A1 Oct. 11, 2007

(51) Int. Cl.
*F04B 41/04* (2006.01)

(52) U.S. Cl. ..... 417/237; 91/503

(58) Field of Classification Search ..... 91/499, 91/503, 507, 474; 92/71; 417/237, 269, 417/270; 60/407
See application file for complete search history.

(56) References Cited

U.S. PATENT DOCUMENTS 646,024 A * 3/1900 Goodhart ..... 91/499
666,840 A * 1/1901 Arnold ..... 91/482
1,229,009 A 6/1917 Allison
1,351,365 A 8/1920 Bower
1,352,985 A 9/1920 Murphy
1,487,338 A 3/1924 Kelley
1,521,884 A * 1/1925 Higgins, Jr. ..... 74/22 R
1,553,022 A * 9/1925 Benson ..... 91/6.5
1,802,902 A 4/1931 Brau
1,810,017 A 6/1931 Houston
2,027,076 A 1/1936 Volliman
2,095,255 A * 10/1937 Holmes ..... 91/498
2,237,430 A * 4/1941 Higgins ..... 91/503
2,237,621 A 4/1941 Herrmann
2,237,989 A 4/1941 Herrmann
2,243,817 A 5/1941 Herrmann
2,243,818 A 5/1941 Herrmann
2,243,819 A 5/1941 Herrmann
2,839,008 A * 6/1958 Stansfield et al. ..... 91/502
2,966,899 A 1/1961 Herrmann
2,992,619 A * 7/1961 Nilges ..... 91/499
3,150,603 A * 9/1964 Yarger ..... 91/477
3,246,575 A * 4/1966 Raymond ..... 91/503
3,272,079 A * 9/1966 Bent ..... 91/499
3,456,630 A 7/1969 Karlan
3,661,059 A * 5/1972 Hunter et al. ..... 91/499
3,745,887 A 7/1973 Striegl
3,807,283 A * 4/1974 Alderson et al. ..... 91/499

(Continued)

FOREIGN PATENT DOCUMENTS

CH 58995 8/1911

(Continued)

*Primary Examiner*—Devon C Kramer
*Assistant Examiner*—Amene S Bayou
(74) *Attorney, Agent, or Firm*—Armstrong Teasdale LLP

(57) ABSTRACT

A motor assembly including a body that includes a plurality of cylinders and a plurality of air channels and a conical shaped piston slidably coupled within each of said plurality of cylinders. The motor assembly also includes a rotatable timing shaft positioned concentric to and at least partially housed within the body and in flow communication with an air source and the plurality of air channels and a cam plate coupled to the timing shaft and configured to engage the pistons and generate torque.

31 Claims, 9 Drawing Sheets

U.S. PATENT DOCUMENTS 3,823,557 A * 7/1974 Van Wagenen et al ..... 60/325
3,986,436 A * 10/1976 Kaufman et al. ..... 91/502
4,090,478 A 5/1978 Trimble et al.
4,188,859 A * 2/1980 VanWagenen et al. ..... 91/499
4,211,148 A * 7/1980 Boss ..... 91/499
4,347,778 A * 9/1982 Murray ..... 91/180
4,432,310 A 2/1984 Waller
4,492,188 A 1/1985 Palmer et al.
4,598,627 A * 7/1986 Brisland ..... 91/477
4,805,516 A * 2/1989 Mori et al. ..... 91/503
4,928,576 A * 5/1990 Armstrong ..... 91/499
4,974,555 A 12/1990 Hoogenboom
4,979,406 A 12/1990 Waller
5,733,105 A * 3/1998 Beckett et al. ..... 417/269
5,755,562 A * 5/1998 Novacek et al. ..... 417/269
5,950,580 A 9/1999 Birckbichler
6,092,457 A * 7/2000 Inoue et al. ..... 92/129
6,179,574 B1 * 1/2001 Yie ..... 417/269
6,283,009 B1 * 9/2001 Hayashi et al. ..... 92/71
6,312,231 B1 * 11/2001 Kuhne et al. ..... 417/222.1
6,619,244 B1 9/2003 Ho
6,662,707 B1 * 12/2003 Stolzer ..... 92/71
2004/0228740 A1 * 11/2004 Matsumoto et al. ..... 417/269

FOREIGN PATENT DOCUMENTS

GB 251607 4/1926

* cited by examiner

AXIAL CAM AIR MOTOR

BACKGROUND OF THE INVENTION

This invention relates generally to air motors, and more particularly, to axial cam air motors.

At least some known engines, for example, an internal combustion engine, include a piston that is positioned in a cylinder. The piston has a roller at its base that rides on an undulating cam surface and the cam is coupled to a flywheel. Typically, an explosion in the cylinder pushes the piston roller onto the cam surface. As the piston engages the cam surface, the axial motion of the piston is converted into the rotary motion of the cam about an axis parallel to the piston. The cam engages a fly wheel that rotates pushes the piston back into the cylinder.

Although the internal combustion engine described above has proven to be reliable, it is dependent on an ignitable fuel source. The high cost of fuel sources, as well as the challenges associated with transporting fuel sources, may limit applications in which an internal combustion engine is used. Moreover, the reliance on a flywheel reduces ability to start and/or stop the engine.

In other known motors, for example, a hydraulic axial piston motor, a piston is mounted in a cylinder positioned in a rotatable cylinder block. The cylinder block is coupled to an output shaft. Typically, high pressure oil is pumped into the cylinder forcing the piston to move in the chamber. As the piston engages the cylinder block, the axial motion of the piston is converted into the rotary motion of the block about an axis parallel to the piston. The rotation of the cylinder block generates torque to the output shaft.

Hydraulic motors are used, for example, to drive large vehicles and heavy machinery. Such motors, however, are dependent on closed oil pressure systems. The high cost of maintaining these systems, as well as the weight and size challenges associated with transporting oil reservoirs, may limit applications in which a hydraulic motor is used.

BRIEF DESCRIPTION OF THE INVENTION

In one aspect, a motor assembly is provided. The motor assembly includes a body having a plurality of cylinders, a plurality of air channels, and a plurality of conical shaped pistons slidably coupled within each of the plurality of cylinders. The motor assembly also includes a rotatable timing shaft positioned concentric to and at least partially housed within the body and in flow communication with an air source. The plurality of air channels and a cam plate are coupled to the timing shaft and are configured to engage the pistons and generate torque.

In another aspect, a motor is provided. The motor includes a cylindrical body fixedly mounted to a motor base. The body includes a plurality of cylindrical bores disposed radially around and parallel to a timing bore. A plurality of air channels extend radially outward from the timing bore. A plurality of substantially hollow pistons including a conical nose, each of the plurality of pistons is slidably coupled within each of the respective cylindrical bores. The motor also includes a timing shaft coupled to an air source and rotatably coupled within the timing bore. The timing shaft has a circular mounting flange at a first end and a plurality of timing ports at a second end. The timing ports are in flow communication with the plurality of air channels. The motor further includes a flat, circular cam plate coupled to the timing shaft mounting flange. The cam plate has a plurality of symmetrical cam lobes on a face opposite the timing shaft mounting flange. The cam lobes are configured to engage each piston conical nose. An output mechanism is configured to transmit torque generated by the pistons.

In yet another aspect, a method for assembling an air motor is provided. The method includes providing a body having a plurality of cylinders and a plurality of air channels, and slidably coupling a conical shaped piston within each cylinder. The method also includes coupling a timing shaft to an air source so that the air source is in flow communication with the plurality of air channels, and coupling a cam plate to the timing shaft and to the conical shaped pistons.

DETAILED DESCRIPTION OF THE INVENTION

Figure 1:
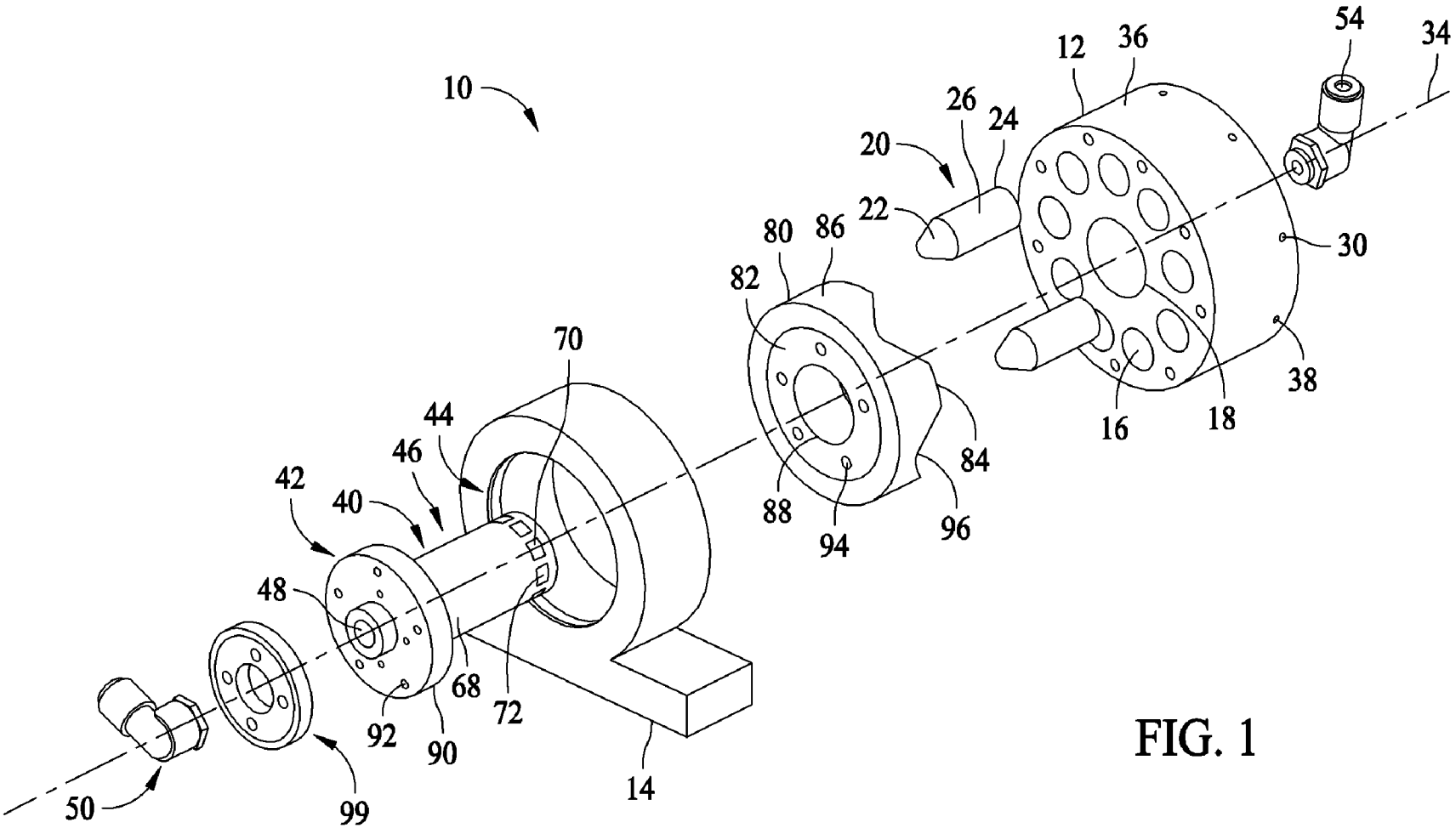
FIG. 1 is an exploded perspective view of a motor assembly.
Figure 2A:
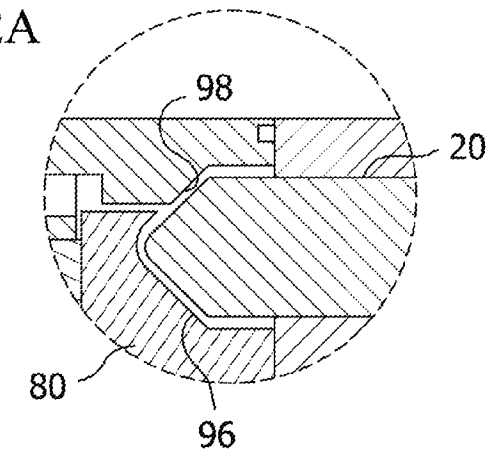
FIG. 2A is a cross-sectional view of the mechanical limit configuration of the motor assembly shown in FIG. 2.
Figure 2:
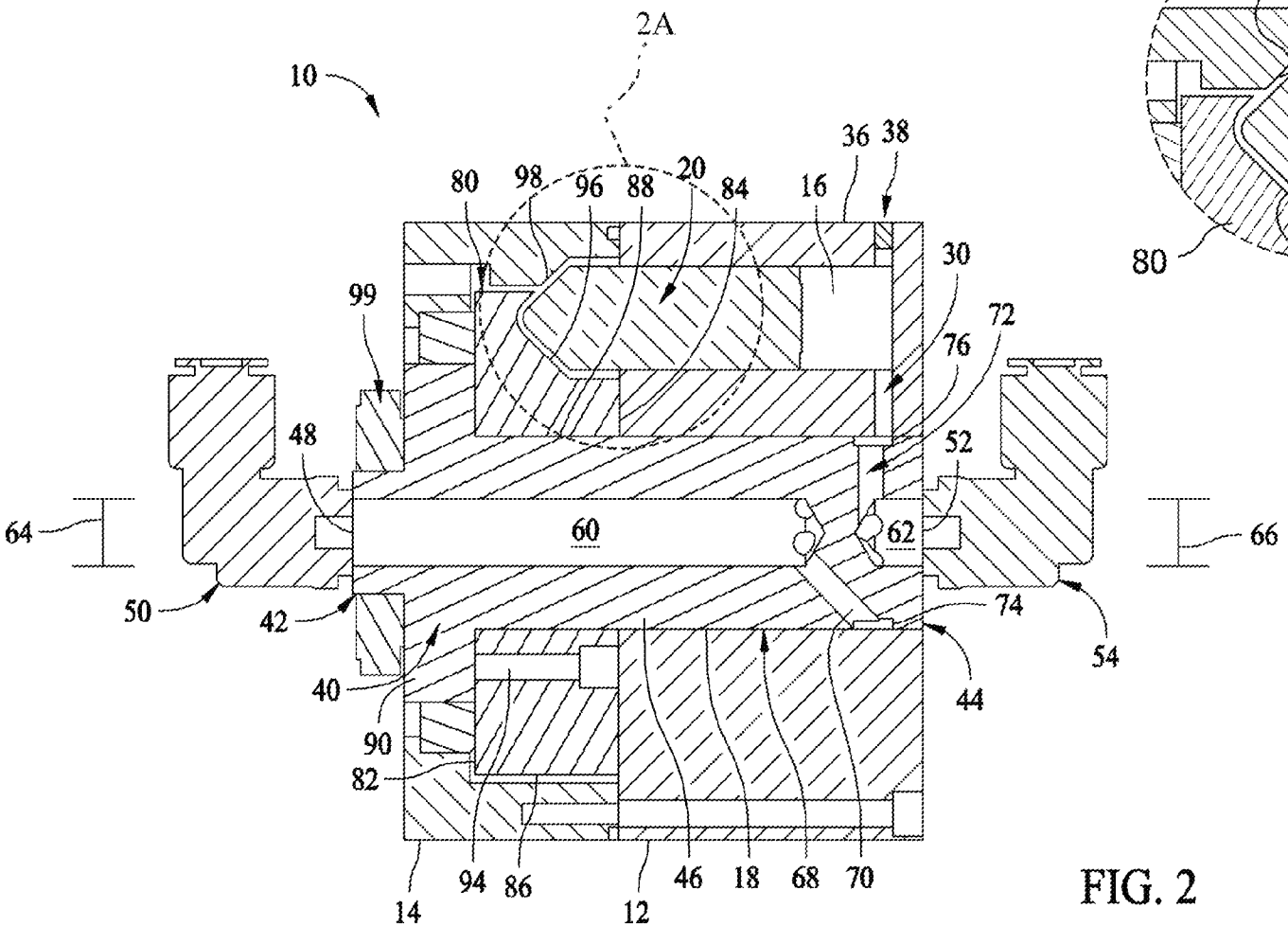
FIG. 2 is a cross-sectional view of the motor assembly in FIG. 1.
Figure 3:
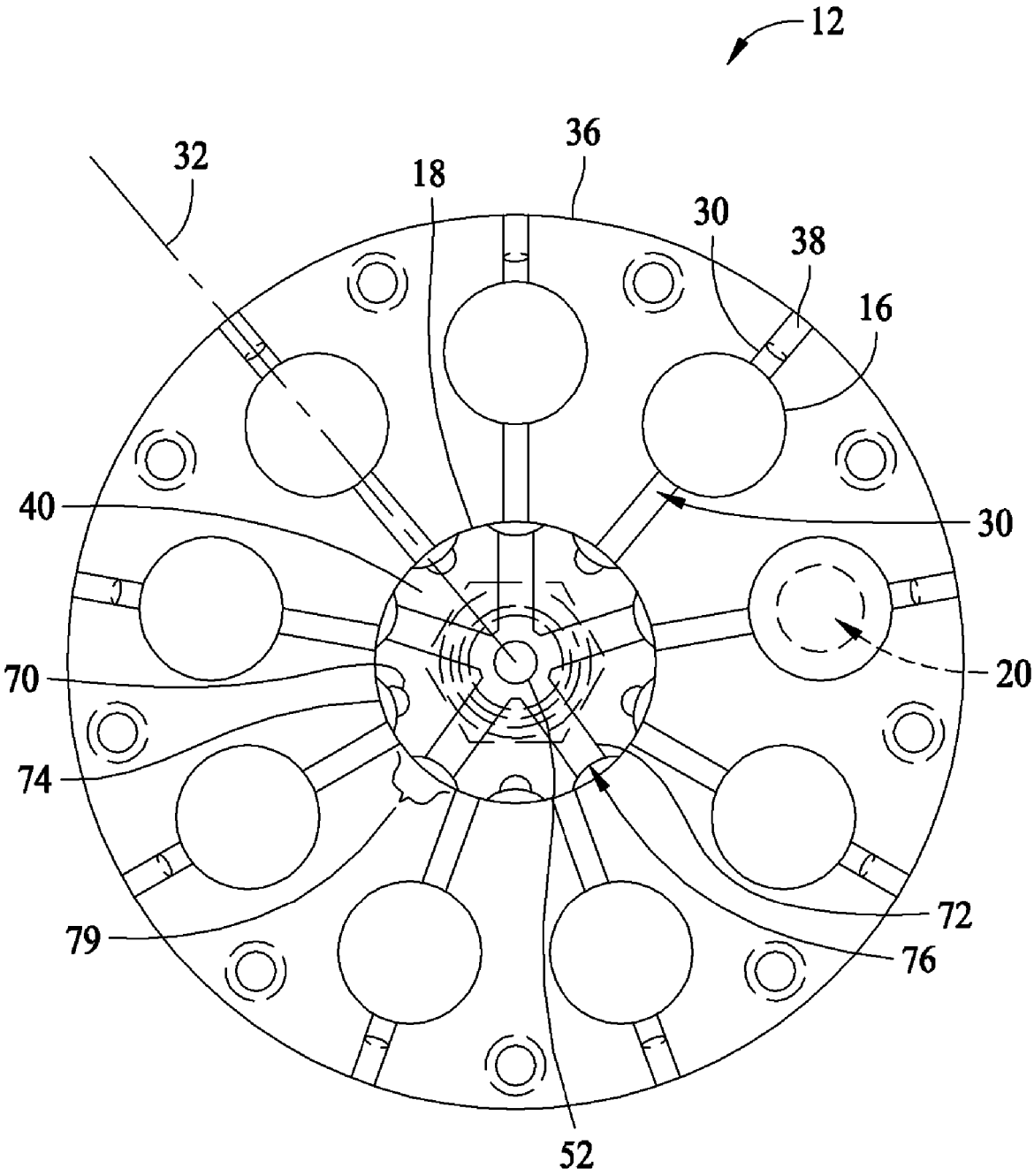
FIG. 3 is a cross-sectional view of a cylindrical body shown in FIG. 1.

FIG. 1 is an exploded perspective view of a motor assembly 10 including a cylindrical body 12 configured to fixedly mount a motor base 14. FIG. 2 is a cross-sectional view of motor assembly 10 and FIG. 3 is a cross-sectional view of body 12 shown in FIG. 1. Body 12 includes a plurality of cylindrical bores or cylinders 16 positioned radially around and parallel to a central timing bore 18.

Body 12 may be fabricated from any material, or combinations of materials, or alloys, or both, suitable for the required torque transmission and the operational environment. Body 12 is preferably fabricated from Delrin®, an acetal homopolymer available from E.I. Du Pont De Nemours and Company Corporation, Wilmington, Del. (Delrin is a registered trademark of E.I. Du Pont De Nemours and Company Corporation, Wilmington, Del.). Alternatively, body 12 may be fabricated from other materials, including, but not limited to, brass, bronze, and aluminum. With respect to the manufacture of body 12, for example, body 12 may be machined using precision boring. Alternatively, body 12 could be manufactured using alternative techniques, including, but not limited to, milling, forging, grinding, cutting, injection molding, extrusion, casting, and sintering processes.

Motor assembly 10 includes a plurality of pistons 20, each slidably coupled within each respective cylinder 16. Each piston 20 includes a first end 22, a second end 24, and a body 26 extending therebetween. In the exemplary embodiment, each piston first end 22 is substantially tapered or conically shaped.

Body 12 further includes a plurality of air inlet/outlet channels 30 circumferentially spaced around timing bore 18 and in flow communication with timing bore 18 and each respective cylinder 16. In the exemplary embodiment, each air channel 30 is oriented such that a channel center axis 32 is radially aligned with respect to a body center axis 34. In the exemplary embodiment, each air channel 30 originates at timing bore 18, extends through cylinder 16, and terminates at a body outer surface 36. Each air channel 30 is sealed by a set screw and/or a plug 38.

A rotatable timing shaft 40 has a first end 42, a second end 44, and a body 46 extending therebetween. In the exemplary embodiment, first end 42 has an opening 48 coupled to an air inlet/outlet member 50 and second end 44 has an opening 52 coupled to an inlet/outlet member 54. Inlet/outlet members 50 and 54 couple timing shaft 40 to an air source (not shown) and may function as either an air input source or and an air output source. Alternatively, inlet/outlet members 50 and 54 may be coupled to body 12 depending on the potential use of motor assembly 10. In one embodiment, inlet/outlet members 50 and 54 are coupled substantially perpendicular to body outer surface 36. In another embodiment, inlet/outlet members 50 and 54 are both coupled to either shaft first end 42 or shaft second end 44.

Timing shaft body 46 has a first air passage 60 originating at opening 48 and extending at least partially through body 46 in a first direction and co-axially aligned with a second air passage 62 originating at opening 52 and extending at least partially through body 46 in a second direction opposite first direction. In the exemplary embodiment, first air passage 60 has a diameter 64 and a second air passage 62 has a diameter 66. Diameters 64 and 66 are substantially equal. Alternatively, diameters 64 and 66 are not equal.

Timing shaft body 46 further includes an outer surface 68 and a plurality of timing ports 70 and 72 circumferentially spaced around body outer surface 68 and in flow communication with air passages 60 and 62, respectively. Specifically, each timing port 70 extends between first air passage 60 and a body opening 74 and each timing port 72 extends between second air passage 62 and a body opening 76, whereby ports 70 and 72 alternate around an outer perimeter 78 of body 46.

As timing shaft 40 rotates, timing ports 70 and 72 alternate between functioning as air inlet ports and outlet ports, respectively. Timing ports 70 and 72 are not in direct communication with one another, but at least one timing port 70 aligns with air inlet channel 30 and another timing port 72 aligns with air outlet channel 30. A dead zone 79 (shown in FIG. 3) is defined between each air channel 30. Dead zone 79 is wide enough to block air passage and thus prevent substantial leakage during rotation of timing shaft 40. In the exemplary embodiment, five timing ports 70 and five timing ports 72 are positioned circumferentially around body perimeter 78. Alternatively, body 46 has any number of ports 70 and 72 positioned circumferentially around body perimeter 78.

A flat, circular cam plate 80 is rotatably coupled to timing shaft 40 and includes a first surface 82, a second surface 84, and a body 86 extending therebetween. Cam body 86 includes a bore 88 extending therethrough and sized to receive timing shaft body 46. Cam first surface 82 is secured to a timing mounting flange 90 by a plurality of fasteners which are insertable through aligned flange openings 92 and cam openings 94. A plurality of symmetrical cam lobes 96 are defined on cam second surface 84. Cam plate 80 and cam lobes 96 are discussed in greater detail below.

In one embodiment, each cylinder 16 includes a mechanical limit 98 positioned therein and configured to restrict piston 20 movement at the bottom end of a piston stroke. Limit 98 facilitates reducing friction between each piston 20 and the bottom of the cam lobe 96 before it reverses direction. FIG. 2A shows a detailed view of the mechanical limit 98 configuration. The mechanical limit 98 is at the same angle to the piston as the earn lobe 96, but the limit 98 is slightly offset towards the piston 20 such that at the end of its stroke, the piston 20 contacts the limit 98 and does not make contact with the bottom of the cam lobe 96. With such a configuration, the piston 20 does not drag on the bottom of the earn lobe 96 before it reverses direction. This has the effect of reducing overall friction in the system. In alternative embodiments, limit 98 is not positioned with each cylinder 16.

In operation, pressurized air from an air source travels through air inlet member 50 and is directed into air passage 60. When timing ports 70 are aligned with an air channel 30, air is diverted into a cylinder 16. The pressurized air pushes piston 20 against cam second surface 84 and cam lobes 96 rotating cam plate 80 and timing shaft 40. As rotation continues, subsequent pistons 20 are exposed to pressurized air as the others are exhausted, further continuing the rotation of cam plate 80. When pistons are exhausted, exhausted air is directed through air passage 62 and air outlet member 54. As timing shaft 40 rotates, ports 70 and 72 alternate between functioning as air inlet ports and outlet ports. As motor assembly 10 is fully pressurized, at least two pistons 20 push against cam second surface 84 and cam lobes 96. An output mechanism 99, such as, for example, a shaft, a gear, or a pulley, is coupled to timing shaft 40 and is configured to can transmit the torque generated by cam plate 80 to an apparatus (not shown).

Timing shaft 40 is configured to continuously rotate when air pressure is applied to air passage 60, to freely rotate in either direction when at ambient air pressure, and to prevent rotation when air passages 60 and 62 are both exposed equally to air pressure that is substantially higher than ambient pressure. When air is reversed through air passages 60 and 62, motor assembly 10 will reverse direction. When air pressure is removed and a torque is applied to motor assembly 10, such that pistons 20 slide out of the way, the motor assembly 10 will free wheel. In another alternative embodiment, motor assembly 10 can be used as a brake when air pressure is applied to both air passages 60 and 62. Timing ports 70 and 72 enable greater than ambient air pressure to move pistons 20 axially within their respective cylinders 16 when timing ports 70 are aligned with air outlet channels 30 and when timing ports 72 are aligned with inlet air channels 30. As such, motor assembly 10 is reversible, with same performance in either direction and capable of starts, stops, and reverses almost instantaneously.

Figure 4:
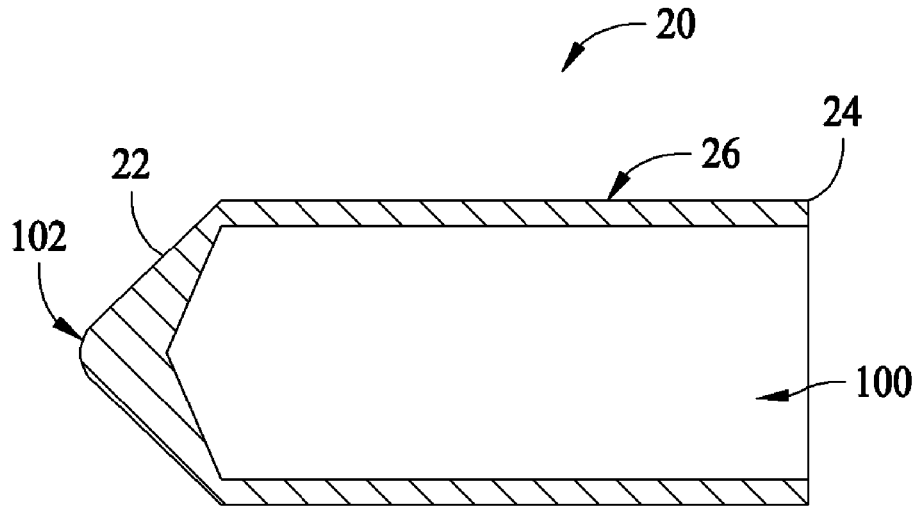
FIG. 4 is a cross-sectional view of an exemplary embodiment of a piston shown in FIG. 1.

FIG. 4 is cross-sectional view of an exemplary embodiment of piston 20. Piston 20 may be fabricated from any material, or combinations of materials, or alloys, or both, suitable for the required torque transmission and the operational environment. In the exemplary embodiment, piston 20 is fabricated from bronze. However, due to the weight of bronze, piston 20 is fabricated with a substantially hollow body 26. Moreover, to prevent hollow body 100 from creating a larger air chamber, and thus a slower response time, hollow body 100 is filled with a light-weight filler such as, for example, a foam material or a cork material.

As discussed above, each piston first end 22 is substantially bullet or conical shaped, and as such, piston 20 contacts cam lobes 96 (shown in FIG. 1) at or near a tip portion 102 of first end 22. In operation, tip portion 102 is configured to slide on a greased surface of cam lobe 96. Tip portion 102 is substantially a point of constant radius and thus has substantially one surface contact speed. Furthermore, the conical shaped design is easy to manufacture with respect to other shapes which could be quite difficult and/or impractical to manufacture. In an alternative embodiment, pistons 20 can be spring-loaded and biased toward cam second surface 84. Biasing the pistons 20 adds back-drive torque.

Figure 5:
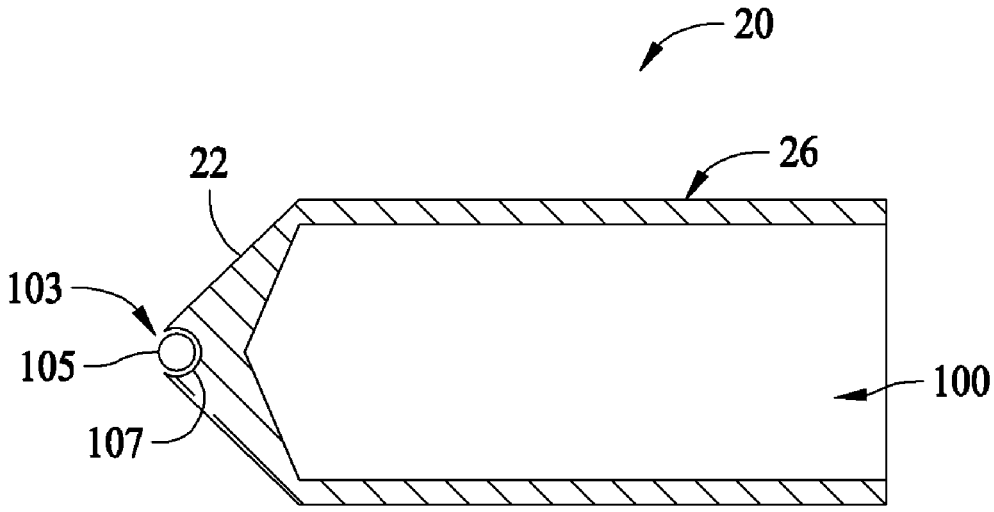
FIG. 5 is a cross-sectional view of an alternative embodiment of a piston shown in FIG. 4.

FIG. 5 is cross-sectional view of an alternative embodiment of piston 20. Piston first end 22 includes a tip portion 103 configured to engage cam lobe 96. In the exemplary embodiment, tip portion 103 includes a bearing or ball 105 configured to turn in a socket 107 as piston 20 contacts cam lobe 96. Tip portion 103 facilitates reducing the necessity to lubricate or grease the surface of cam lobe 96. In one embodiment, tip portion 103 is self-lubricating, such that piston 20 includes a lubricant reservoir (not shown) in flow communication with bearing 105.

Figure 6:
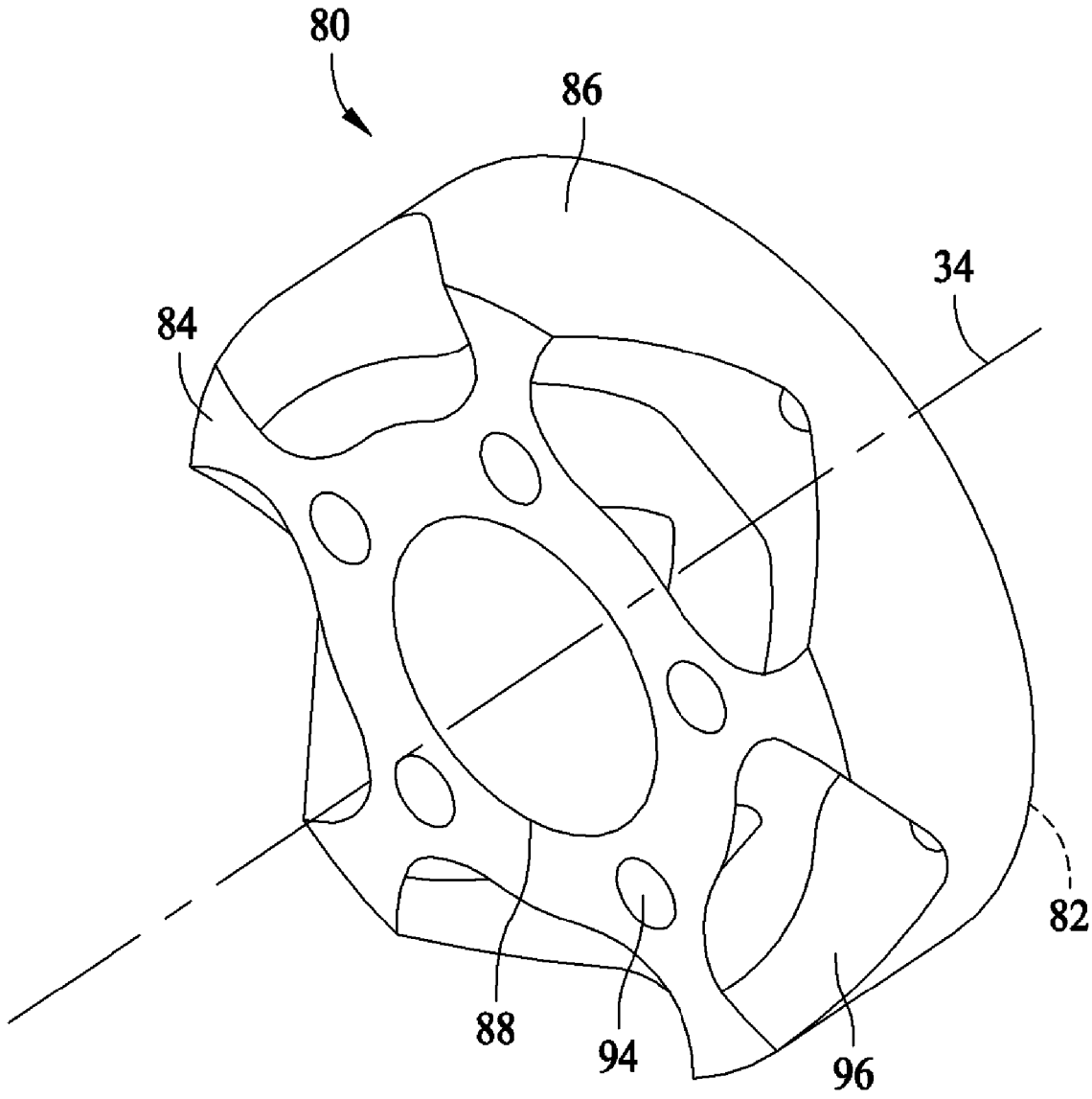
FIG. 6 is perspective view of the cam plate shown in FIG. 1.

FIG. 6 is perspective view of cam plate 80 shown in FIG. 1. Cam plate 80 is a simple sinusoidal curve that is co-axially aligned with central timing bore 18. Cam lobes 96 are evenly spaced and substantially perpendicular to body center axis 34. Cam lobes 96 are oriented towards body 12 and are positioned such that each piston conical end 102 engages cam second surface 84 and cam lobes 96.

Selecting the number of lobes 96 and/or number of cylinders 16 for motor assembly 10 depends on the mathematical relationship between the circumference of the cylinder circle (not shown), lobes 96, and timing shaft 40. It is ideal to have six, nine, or eighteen cylinders with the appropriate number of lobes 96 such that the number of lobes is not a multiple of the number of cylinders. Such a relationship allows for each piston 20 to transition at a different time than other pistons 20. The end result is the smoothest torque output of the motor assembly 10. In the exemplary embodiment, cam plate 80 includes five lobes 96 each oriented at a forty-five degree angle with three of the nine pistons 20 engaged at all times, this relationship holds true independent of the number of lobes 96. In an alternative embodiment, cam plate 80 includes four lobes 96 each oriented at a forty degree angle with two of the nine pistons 20 engaged at all times. Using fewer lobes 96 may result initially in less torque output, however, this problem can be solved by making a slightly larger motor. Using four lobes facilitates smoother operation at higher speeds and smoother back-drive qualities. Additionally, fewer lobes will result in less leakage in timing shaft 40. Less leakage will lead to more torque output and the increase in torque could partially offset the loss of one engaged piston 20.

Cam plate 80 is preferably fabricated from suitable materials including, but not limited to, Delrin®, brass, and aluminum with a hard-anodized coating. Alternatively, body 12 may be fabricated from any other material, or combinations of materials, or alloys, or both, suitable for the required torque transmission and the operational environment. Performance of cam plate 80 and piston 20 increases when cam plate 80 is selected from a different material than piston 20, for example, brass pistons 20 and Delrin® cam plate 80. With respect to the manufacture of cam plate 80, for example, may be machined using a cutter (not shown) that has a cutter geometry that is the same shape as piston first end 22. Cam plate 80 may be machined using a three axis programmable drill. Alternatively, cam plate 80 could be manufactured using alternative techniques including, but not limited to, milling, forging, and grinding, injection molding, extrusion, casting, and sintering processes.

Figure 7:
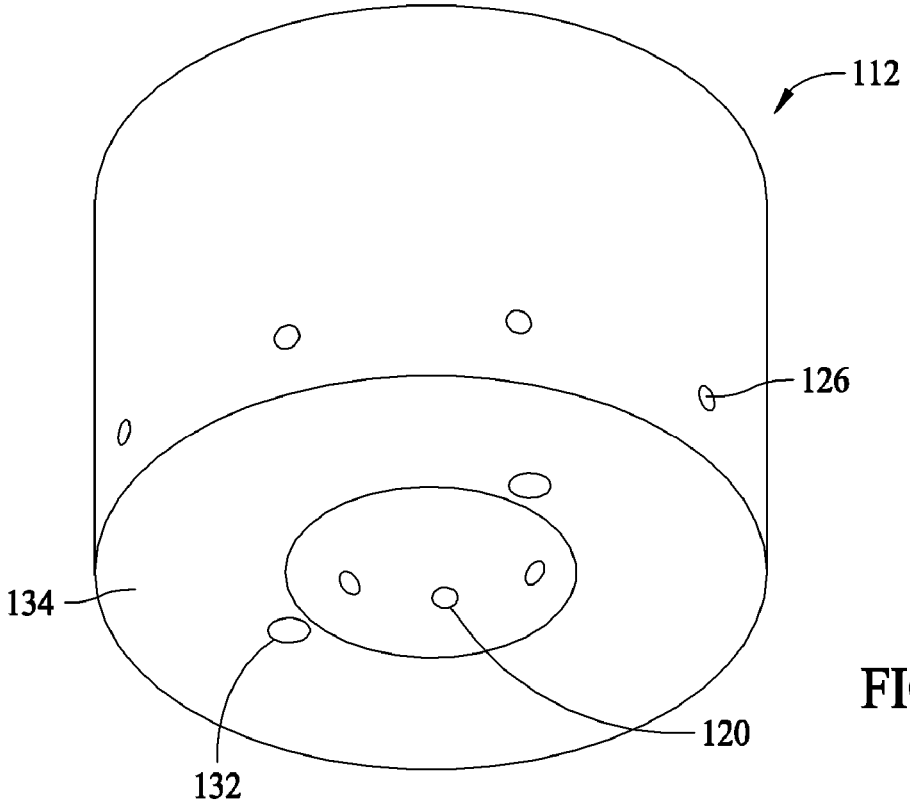
FIG. 7 is a perspective view of an alternative embodiment of a cylindrical body shown in FIG. 1.
Figure 8:
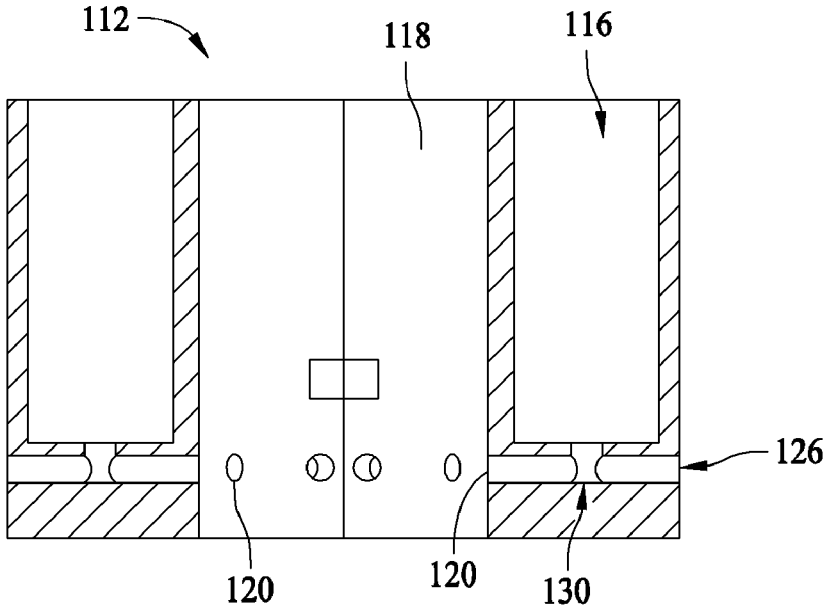
FIG. 8 is a cross-sectional view of the alternative embodiment of cylindrical body shown in FIG. 7.
Figure 9:
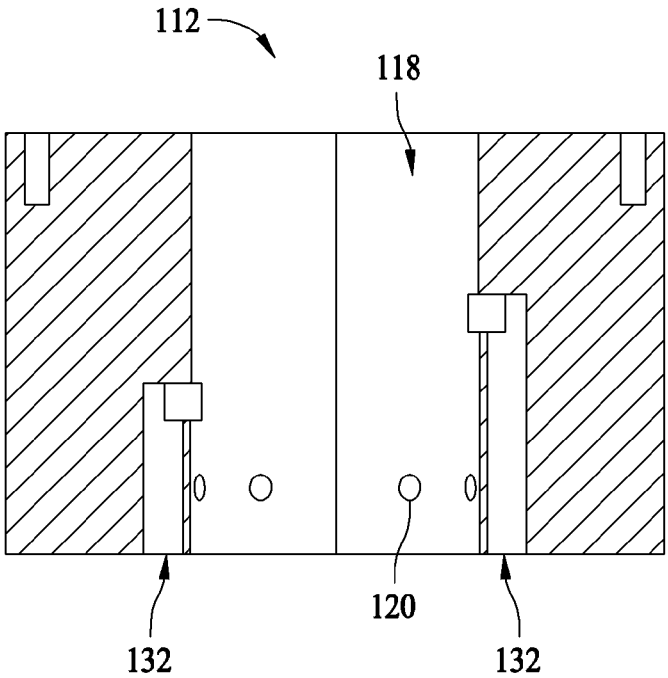
FIG. 9 is a cross-sectional view of the alternative embodiment of cylindrical body shown in FIG. 7.
Figure 10:
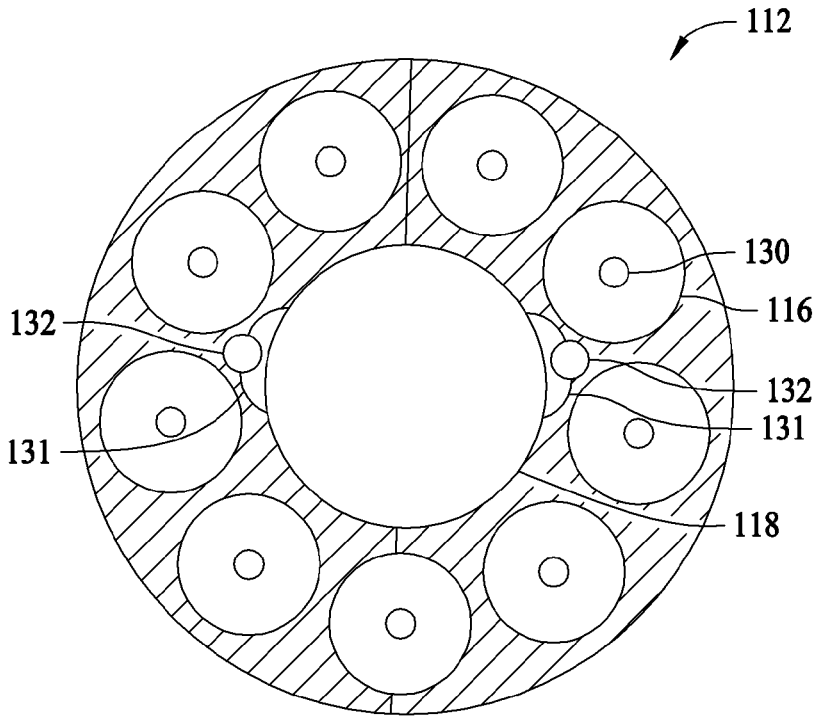
FIG. 10 is a cross-sectional view of the alternative embodiment of cylindrical body shown in FIG. 7.

FIG. 7 is perspective view of an alternative embodiment of a cylindrical body 112. FIGS. 8, 9, and 10 are cross-sectional views of body 112. Body 112 is configured to fixedly mount to motor base 14 (shown in FIG. 1). Body 112 includes a plurality of cylinders 116 positioned radially around and parallel to a central timing bore 118. In the exemplary embodiment, each cylinder 116 includes an inlet/outlet channel 120 whereby each channel 120 is radially aligned with respect to a center axis 124 of cylinder body 112. Each channel 120 is sealed by a plug 126 and supplied pressurized air by an air inlet port 130 positioned substantially parallel to axis 124. Each air inlet port 130 is configured to supply and return air to timing mechanism (not shown). Specifically, each air inlet port 130 is in flow communication with plenum 152 (shown in FIGS. 11 and 12) via a pair of partial grooves 131.

Body 112 further includes at least two supply ports 132 in flow communication with bore 118 and an outer surface 134 of body 112. Ports 132 are substantially parallel to axis 124 and extend through outer surface 134. Ports 132 are shorter that air passages 60 and 62 (shown in FIG. 2). Shorter air passages lead to faster engine response times.

Figure 11:
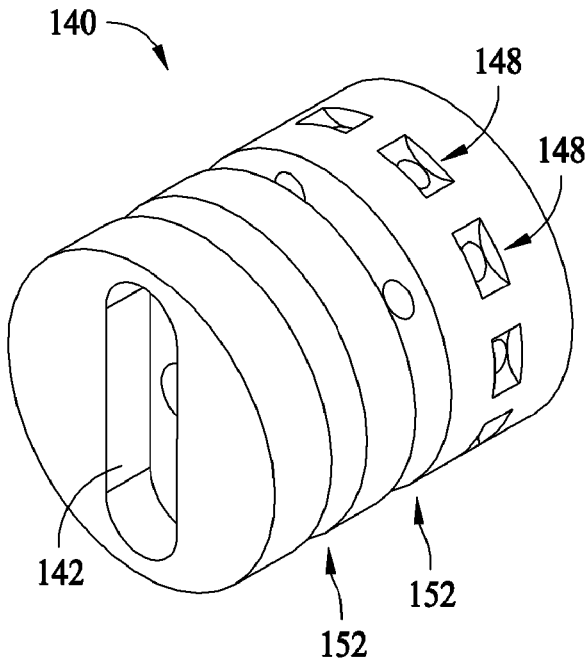
FIG. 11 is a perspective view of an alternative embodiment of a timing shaft shown in FIG. 1.
Figure 12:
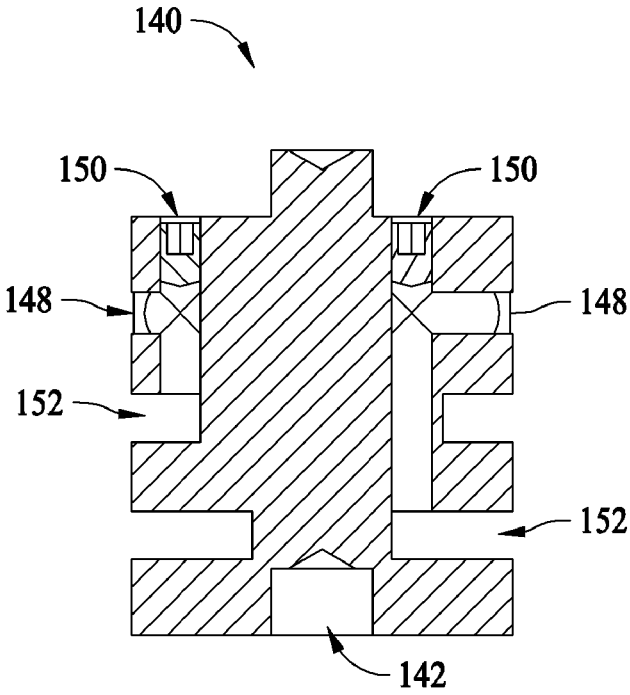
FIG. 12 is a cross-sectional view of the alternative embodiment of timing shaft shown in FIG. 11.
Figure 13:
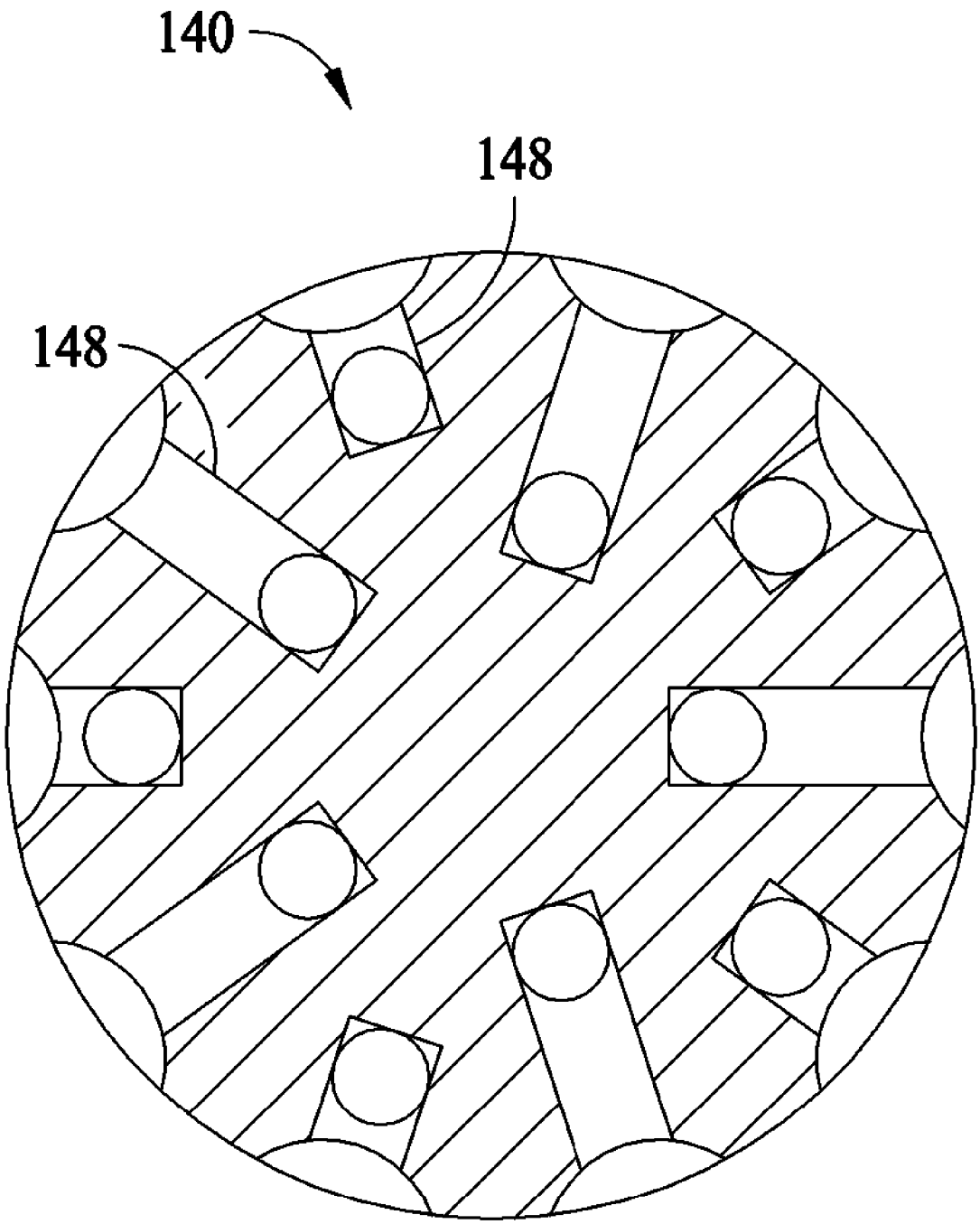
FIG. 13 is a cross-sectional view of the alternative embodiment of timing shaft shown in FIG. 11.

FIG. 11 is perspective view of an alternative embodiment of timing shaft 140. FIGS. 12 and 13 are cross-sectional views of timing shaft 140. In the exemplary embodiment, timing shaft 140 is separate from output mechanism 99 (shown in FIG. 1). Specifically, timing shaft 140 is not fixedly coupled to output mechanism 99. This facilitates reducing the effects of any misalignment of output mechanism 99. Timing shaft 140 includes a timing alignment slot 142 that transfers rotation, but not a moment in the shaft 140 to output mechanism 99. This allows timing shaft 140 to spin without uneven loading on the internal timing surfaces (not shown).

Rotatable timing shaft 140 is positioned concentric to and at least partially housed within cylindrical body 112 (shown in FIGS. 7-10). Timing shaft 140 includes a plurality of timing ports 148 wherein timing ports 148 are configured to engage respective air channels 120 of cylinder body 112 to provide an inlet and an outlet for pressurized air. Each timing port 148 is sealed at one end by a plug 150 and extends to a corresponding plenum 152.

In operation, air travels through supply ports 132 and is diverted to an appropriate cylinder 116 when timing ports 148 align with respective air channels 120. The air inlet channels and outlet channels alternate around a perimeter of timing shaft 140. A dead zone (not shown) is defined between each air channel 120. Dead zone is wide enough to block the air passage and thus prevent substantial leakage during rotation of timing shaft 140.

As timing shaft 140 rotates, timing ports 148 alternate between functioning as air inlet ports and outlet ports, respectively, none of timing ports 148 are in direct communication with one another, but at least one timing port 148 aligns with air inlet channel 120 and another timing port 148 aligns with air outlet channel 120. Timing ports 148 enable greater than ambient air pressure to move pistons 20 (shown in FIG. 1) axially within their respective cylinders 116 when timing ports 148 are aligned with air outlet channels 120 and when timing ports 148 are aligned with air inlet channels 120.

The above-described air motors are efficient, cost effective, and highly reliable. The air cam motor includes a plurality air-driven conical shaped pistons configured to engage and drive a rotatable cam thereby producing torque. The use of air facilitates reducing the dependence on expensive ignitable fuels or leak prone closed oil systems to drive. Furthermore, the air cam motor is reversible, with the same performance in either direction. Moreover, the motor is capable of starts and stops substantially instantaneously. As a result, the air cam motor facilitates improving efficiency in a cost effective and reliable manner.

Exemplary embodiments of air cam motors with conical shaped pistons and a multi-channeled timing shaft are described above in detail. The air cam motors are not limited to the specific embodiments described herein, but rather, components of the air cam motors may be utilized independently and separately from other components described herein. Each air cam motor component can also be used in combination with other air cam motor components.

While the invention has been described in terms of various specific embodiments, those skilled in the art will recognize that the invention can be practiced with modification within the spirit and scope of the claims.

What is claimed is:

1. A motor assembly comprising:

a body comprising a plurality of cylinders and a plurality of air channels;

a conical shaped piston slidably coupled within each of said plurality of cylinders;

a rotatable timing shaft positioned concentric to and at least partially housed within said body and in flow communication with an air source and said plurality of air channels, said timing shaft comprising an axis of rotation, a first end, a second end, and a timing shaft body extending therebetween, a first air passage extending longitudinally inward from said first end of said timing shaft partially through said timing shaft body in a first direction, a second air passage originating at said second end of said timing shaft and extending longitudinally inward and partially through said timing shaft body in a second direction opposite first direction such that said second air passage and said first air passage axially aligned with said timing shaft axis of rotation; and a cam plate coupled to said timing shaft and configured to engage said pistons and generate torque.

2. A motor assembly in accordance with claim 1 wherein said body is substantially cylindrical and comprises a timing bore configured to receive said timing shaft therein, said plurality of air channels extending radially outward from a central axis of said body, wherein each said air channel is configured to function as an air inlet channel and/or an air outlet channel.

3. A motor assembly in accordance with claim 1 wherein said timing shaft is rotatable in a first direction when said first end is coupled to an air inlet member and said second end is coupled to an air outlet member, said first air passage is in flow communication with a body air inlet channel and said second air passage is in flow communication with a body air outlet channel.

4. A motor assembly in accordance with claim 1 wherein said timing shaft is rotatable in a second direction opposite said first direction when said first end is coupled to an air outlet member, said second end is coupled to an air inlet member, and said timing shaft body first air passage is in flow communication with said body air outlet channel and said second air passage is in flow communication with said body air inlet channel.

5. A motor assembly in accordance with claim 1 wherein said timing shaft body first air passage is in flow communication with a first timing port and said timing shaft body second air passage is in flow communication with a second timing port, said first and second timing ports in flow communication with said body air inlet and outlet channels.

6. A motor assembly in accordance with claim 1 wherein said plurality of air channels extend at least partially through each said cylinder.

7. A motor assembly in accordance with claim 1 wherein said plurality of cylinders comprise at least one mechanical limit configured to restrict piston movement and facilitate reducing drag on said cam plate.

8. A motor assembly in accordance with claim 1 wherein each said piston comprises a conical nose and a hollow body.

9. A motor assembly in accordance with claim 8 wherein said cam plate comprises a flat, circular body and a plurality of symmetrical cam lobes positioned to engage said piston conical nose.

10. A motor assembly in accordance with claim 1 wherein said timing shaft comprises a circular mounting flange configured to couple to said cam plate such that rotation of said cam plate thereby generates torque to an output mechanism.

11. A motor assembly in accordance with claim 1 wherein said timing shaft comprises a timing alignment slot and a plurality of plenums in flow communication with said plurality of air channels.

12. A motor comprising:

a cylindrical body fixedly mounted to a motor base, said body comprising a plurality of cylindrical bores disposed radially around and parallel to a timing bore and comprising a plurality of air channels extending radially outward from said timing bore;

a plurality of substantially hollow pistons comprising a conical nose, each of said plurality of pistons slidably coupled within each of said respective cylindrical bores;

a timing shaft coupled to an air source and rotatably coupled within said timing bore, said timing shaft having a circular mounting flange at a first end and a plurality of timing ports at a second end, said timing ports in flow communication with said plurality of air channels, said timing shaft comprising an axis of rotation, said first end, said second end, and a timing shaft body extending therebetween, a first air passage extending longitudinally inward from said first end of said timing shaft partially through said timing shaft body in a first direction, a second air passage originating at said second end of said timing shaft and extending longitudinally inward and partially through said timing shaft body in a second direction opposite first direction such that said second air passage and said first air passage axially aligned with said timing shaft axis of rotation;

a flat, circular cam plate coupled to said timing shaft mounting flange, said cam plate having a plurality of symmetrical cam lobes on a face opposite said timing shaft mounting flange, said cam lobes configured to engage each said piston conical nose; and an output mechanism configured to transmit torque generated by said pistons.

13. A motor in accordance with claim 12 wherein each of said plurality of air channels extends at least partially through each respective cylindrical bore and is configured to operate as an inlet air channel and/or an outlet air channel.

14. A motor in accordance with claim 12 wherein said plurality of cylindrical bores further comprises at least one mechanical limit configured to restrict piston movement and facilitate reducing drag on said cam lobes.

15. A motor in accordance with claim 12 wherein each of said plurality of pistons includes a cylindrical, hollow body.

16. A motor in accordance with claim 12 wherein said timing shaft is rotatable in a first direction when said first end is coupled to an air inlet member and said second end is coupled to an air outlet member, said first air passage is in flow communication with a body air inlet channel and a said second air passage is in flow communication with a body air outlet channel.

17. A motor in accordance with claim 16 wherein said timing shaft is rotatable in a second direction opposite said first direction when said first end is coupled to an air outlet member, said second end is coupled to an air inlet member, and said timing shaft body first air passage is in flow communication with said body air outlet channel and said second air passage is in flow communication with said body air inlet channel.

18. A motor in accordance with claim 12 wherein said timing shaft body first air passage is in flow communication with a first timing port and said timing shaft body second air passage is in flow communication with a second timing port, said first and second timing ports in flow communication with said body air inlet and outlet channels.

19. A motor in accordance with claim 12 wherein said timing shaft comprises a timing alignment slot and a plurality of plenums in flow communication with said plurality of air channels.

20. A method for assembling an air motor, said method comprising:

providing a body comprising a plurality of cylinders and a plurality of air channels;

slidably coupling a conical shaped piston within each cylinder;

coupling a timing shaft to an air source so that the air source is in flow communication with the plurality of air channels, wherein the timing shaft comprises an axis of rotation, a first end, a second end, and a timing shaft body extending therebetween, a first air passage extending longitudinally inward from the first end of the timing shaft partially through the timing shaft body in a first direction, a second air passage originating at the second end of the timing shaft and extending longitudinally inward and partially through the timing shaft body in a second direction opposite first direction, the second air passage coaxially aligned with the first air passage, said second air passage and said first air passage axially aligned with said timing shaft axis of rotation; and coupling a cam plate to the timing shaft and to the conical shaped pistons.

21. A method in accordance with claim 20 wherein providing a body further comprises providing a cylindrical body fixedly mounted to a motor base, wherein the plurality of cylinders are positioned radially around and parallel to a timing bore, each cylinder in flow communication with the plurality of air channels.

22. A method in accordance with claim 21 wherein providing a plurality of air channels further comprises extending the plurality of air channels radially outward from and in flow communication with the timing bore.

23. A method in accordance with claim 21 wherein the plurality of air channels alternate between supplying air into the plurality of cylinders and exhausting air from the plurality of cylinders.

24. A method in accordance with claim 20 wherein slidably coupling a conical shaped piston within each cylinder further comprises providing a piston comprising a conical nose and a substantially hollow body configured to engage the cam plate.

25. A method in accordance with claim 24 wherein providing a plurality of conical shaped pistons further comprises providing a piston including a tip portion comprising a bearing rotatably coupled within a socket configured to engage the cam plate.

26. A method in accordance with claim 20 wherein slidably coupling a plurality of conical shaped pistons within each cylinder further comprises biasing the pistons toward the cam plate to facilitate providing a back-drive torque.

27. A method in accordance with claim 20 wherein coupling a timing shaft further comprises coupling the first air passage to a first timing port and coupling the second air passage to a second timing port such that first and second timing ports are in flow communication with the plurality of air channels.

28. A method in accordance with claim 20 wherein coupling a timing shaft further comprises coupling the first air passage to a first air inlet member and coupling the second air passage to a second air outlet member.

29. A method in accordance with claim 28 wherein coupling the first air passage to a first air inlet member and coupling the second air passage to a second air outlet member further comprises coupling the first air inlet member to an air source and coupling the second air inlet member to an air source such that supplying air substantially simultaneously to both the first air inlet member and the second air inlet member locks and/or brakes the motor.

30. A method in accordance with claim 21 wherein coupling a timing shaft further comprises rotatably coupling the timing shaft at least partially within the body timing bore such that the timing shaft is rotatable in a first direction and in a second direction.

31. A method in accordance with claim 30 wherein coupling a timing shaft further comprises coupling the timing shaft to an air source such that removing the air source and applying a torque to the motor facilitates disengaging the pistons and permitting the motor to free spin.

* * * * *